US006605233B2

(12) United States Patent
Knowlton et al.

(10) Patent No.: US 6,605,233 B2
(45) Date of Patent: Aug. 12, 2003

(54) GAS GENERANT COMPOSITION WITH COOLANT

(75) Inventors: Gregory D. Knowlton, Chandler, AZ (US); Christopher P. Ludwig, Fountain Hills, AZ (US)

(73) Assignee: Talley Defense Systems, Inc., Mesa, AZ (US)

( * ) Notice: Subject to any disclaimer, the term of this patent is extended or adjusted under 35 U.S.C. 154(b) by 106 days.

(21) Appl. No.: 09/798,640

(22) Filed: Mar. 2, 2001

(65) Prior Publication Data

US 2003/0089883 A1 May 15, 2003

(51) Int. Cl.[7] ..... H01J 35/20

(52) U.S. Cl. ..... 252/181.1; 149/46; 149/47; 149/55; 149/57; 149/61; 149/62; 149/76; 149/92

(58) Field of Search ..... 252/181.1; 149/46, 149/47, 55, 57, 61, 62, 76, 92

(56) References Cited

U.S. PATENT DOCUMENTS 5,386,775 A * 2/1995 Poole ..... 102/289
5,429,691 A * 7/1995 Hinshaw ..... 149/45
5,780,768 A * 7/1998 Knowlton ..... 149/36
5,844,164 A * 12/1998 Cabrera ..... 102/288

FOREIGN PATENT DOCUMENTS

JP 2001010858 * 1/2001

* cited by examiner

*Primary Examiner*—Cephia D. Toomer
(74) *Attorney, Agent, or Firm*—Fitzpatrick, Cella, Harper & Scinto

(57) ABSTRACT

A low-solids gas generating composition and a method of producing a gas. The gas is produced by combusting a mixture of a fuel selected from the group consisting of guanidine nitrate, nitroguanidine, cellulose, cellulose acetate, hexamine, 5 amino-tetrazole, 5 nitro-uracil, guanidine salt of 5 nitro-uracil, and mixtures thereof, an oxidizer selected from the group consisting of ceric ammonium nitrate, strontium nitrate, basic copper nitrate, a mixture of ammonium perchlorate and at least one alkali metal salt, and mixtures thereof, and a cupric oxalate hemi-hydrate coolant. The oxidizer-fuel mixture is within about 4 percent of stoichiometric balance, and the low-solids gas generating composition produces no more than about 0.082 cubic centimeters of solids per gram of gas generating composition on combustion.

38 Claims, No Drawings

GAS GENERANT COMPOSITION WITH COOLANT

FIELD OF THE INVENTION

The invention is directed to gas generant compositions. In particular, the invention is directed to gas generant compositions containing cupric oxalate hemi-hydrate as a coolant to reduce the temperature of the gas generated upon combustion of the compositions.

BACKGROUND

Single use, i.e., "one shot" gas generators are well known in the art, and have become commonplace for many applications. In general, such gas generators are used to perform work in an emergency or in an a situation requiring the one-time production of a working gas. For such applications, the gas must be produced on demand in a consistent manner with high reliability. That is, the gas must be produced in the amount and at the pressure required, and the gas generator must operate with high reliability when generation of the gas is required. Typical applications include, but are not limited to, inflating automotive air bags, dispersing munitions from a cruise missile with air bags, inflating safety devices, such as buoyancy devices. e.g., life rafts and life preservers, inflating temporary structures, such as airplane escape slides, and moving mechanical devices, such as pistons and rotary actuators, and providing inert gas for fire suppression, etc.

Although pressurized gas stored in a pressure vessel may be utilized in certain applications, pressurized gas sources are large and heavy. As a result, many applications may be performed more efficiently and more reliably using a pyrotechnic gas generating device that produces warm or hot gases from the combustion of a pyrotechnic gas generating material. In general, pyrotechnic gas generators produce more energy per unit mass and per unit volume than do pure compressed gas devices. They are also typically more reliable, as gas may leak out of the pressurized gas systems during storage, resulting in the release of an insufficient amount of gas when the device is finally operated.

The performance requirements of pyrotechnic gas generators vary in accordance with different applications, where the gas produced must meet certain requirements for temperature, toxicity, and corrosiveness. As the choice of pure pyrotechnic gas generators is limited by the selection of gas generant compositions, the development of a gas generant to meet certain performance criteria, such as burn rate, operating pressure, mechanical integrity of the gas generant grains, operational temperature range, and water content, is somewhat of an art. The development of a gas generant generally requires a number of compromises to meet those performance requirements in addition to requirement for gas temperature, toxicity, and corrosiveness. For example, the toxicity and corrosiveness of the effluent gases are of particular concern in many inflatable devices, such as where an inflatable device is used in a confined environment in which humans are present; e.g., automotive air bags. The pyrotechnic gas generants used in such devices often must compromise performance to provide an acceptably low toxicity and corrosiveness in the gas composition.

Inflatable devices also typically require a relatively cool gas to prevent damage to the material from which the inflatable device is fabricated. A relatively cool gas may also be required to keep the inflatable device fully inflated for sustained periods of time, depending on the temperature of the environment. Where the gas used to inflate an inflatable device is significantly hotter than the surrounding environment when the device is initially inflated, the pressure within the device will decrease shortly after the inflation is complete as the gas cools, resulting in at least a partial deflation of the inflated device. Extra gas may be added to the inflatable device to maintain the required inflation pressure after the gas within the device cools. However, the device may be over inflated when the hot gases are initially discharged into the device, potentially rupturing the inflatable device during inflation.

Initially, prior art air bag inflators used a sodium azide/metal oxide based gas generant compositions to inflate the air bags. The sodium azide/metal oxide compositions burn at relatively cool temperatures, on the order of from about 1000° to about 1200° C., and have burn rates sufficiently fast to provide the required air bag inflation times with reasonable gas generant grain sizes and inflator operating pressures. However, those compositions also produce a large amount of unwanted solid combustion products, which, typically, account for about 60 percent of the initial weight of the composition, and include a large percentage of sodium oxide, a highly caustic and corrosive material capable of damaging lung tissues if inhaled in any significant quantity. As a result, filtration is required to remove the solid combustion products from the inflation gases. To provide a sufficiently cool gas, prior art pyrotechnic gas generators thus generally require complex filtration and heat sinking assemblies within the gas generator to remove unwanted solid combustion byproducts and heat from the gas before the gas exits the gas generator. The requirement to thoroughly filter out this toxic solid combustion product significantly adds to the cost and complexity of the filtration system within the sodium azide based air bag inflators. Moreover, sodium azide is highly toxic and hazardous to the environment, making the manufacture and the disposal of old or fired sodium azide based inflators costly and hazardous.

More recent prior art pyrotechnic air bag inflators use pyrotechnic gas generant compositions that are more environmentally friendly than sodium azide based compositions. However, to achieve the same performance as the original sodium azide based inflators in prior art "non-azide" based gas generants generally requires a higher flame temperature than that of the original sodium azide based compositions, requiring additional heat sinking. Cooler burning non-azide based formulations are available, but typically have lower burning rates than azide formulations, and produce high levels of unwanted solid products of combustion, such that complex filtration is required. The prior art non-azide based gas generant formulations also tend to produce higher levels of toxic compounds in their effluent gases, such as, e.g., carbon monoxide, oxides of nitrogen, and hydrogen cyanide.

Hybrid inflators have been developed to mitigate the limitations of the newer non-azide based formulations. Hybrid inflators use a pressurized gas that is heated by a pyrotechnic gas generant to inflate the air-bag. The pressurized gas reduces the amount of gas generant required for the application, and provides additional cool gas to mix with the hotter gases provided by the gas generant composition, thus resulting in an overall lowering of the gas temperature. The pyrotechnic gas generant composition provides energy to the gas, allowing the inflator to meet weight and size requirements that cannot be met by compressed gas sources alone. Hybrid gas generators meet the gas temperature and particulate requirements of the air bag inflators at a lower cost than the first generation sodium azide based gas generators.

However, hybrid inflators are more complex, and may be less reliable due to the use of pressurized gas. A purely pyrotechnic gas generator using a pyrotechnic composition that meets the performance, gas temperature, and toxicity requirements would be less expensive, less complex, and more reliable. However, a gas generant meeting all the air bag inflator requirements does not exist in the prior art.

A number of prior art second generation air bag gas generators use 5-amino tetrazole as a primary fuel in non-azide based gas generants. Most second generation gas generants provide adequate burn rates and operating pressures, but have flame temperatures as high as from about 2500° to about 3000° C. without the use of a coolant. For example, U.S. Pat. No. 5,035,757 to Poole discloses strontium nitrate as the primary oxidizer for a 5-amino tetrazole fuel in second generation gas generants. This composition is typically stoichiometric in oxidizer fuel balance to minimize the formation of carbon monoxide and oxides of nitrogen, such as NO, $NO_2$, and $N_2O$, and has a number of desirable characteristics. In particular, with reasonably sized gas generant grains, it ignites easily and burns fast enough to allow for low operation pressures, i.e., from about 1000 to about 3000 psi. It also produces a relatively low volume of solids upon combustion, i.e., about 0.08 cubic centimeters of theoretical solid volume per gram of gas generant combusted, and uses relatively inexpensive ingredients.

However, the adiabatic flame temperature of a stoichiometric mixture of strontium nitrate and 5 amino tetrazole is about 2700° C., when calculated using the thermochemical equilibrium combustion code PEPCODE, a commercially available computer program that calculates flame temperatures based upon the components of a composition. Such a flame temperature is about 1600° C. higher than typical first generation sodium azide formulations. As a result, a substantial increase in the amount of heat sinking or the addition of a coolant is required to bring the gas temperature into a manageable range. Heat sinking increases the volume, weight, and cost of the gas generator, and tends to increase the gas toxicity above acceptable levels. The increase in toxicity is due, at least in part, to catalytic interactions between the hot heat sink surface and the gases, forming toxic species, such as oxides of nitrogen and hydrogen cyanide. In addition, the amount of heat sinking required to provide a decrease in temperature of over 1000° C. in the gas results in a significant increase in the temperature of the device after firing because of the energy absorbed by the heat sink. As a result, there is a significant burn risk to the occupants of a vehicle equipped with such an inflator.

Prior art coolants can add significant quantities of solids to gas generant combustion effluents, requiring additional filtration and, thus, additional unit cost and complexity. Coolants also tend to significantly reduce the burn rate of the gas generant composition when used in quantities sufficient to provide useful cooling of the flame, increasing operating pressure requirements, and decreasing gas generant grain sizes both of which add to unit cost. Some examples of typical coolants used are metal carbonates, such as, e.g., sodium carbonate, potassium carbonate, magnesium carbonate, and calcium carbonate, and metal oxides, such as, e.g., aluminum oxide, magnesium oxide, zinc oxide, and iron oxide.

For example, U.S. Pat. No. 6,051,158 to Taylor et al. discloses a chemical coolant formulation for use with air bag inflators. The formulation includes a "first coolant ingredient" that endothermically decomposes when contacted by a hot gas to form a cooling gas and a solid slag component. Disclosed coolants include metal carbonates, metal hydroxide, and hydrated metal salts. Disclosed hydrated metal salts are limited to $MgSO_4.7H_2O$ and $MgCl_2.6H_2O$. However, for use in an inflator, the slag component requires extensive filtering of the generated gas.

U.S. Pat. Nos. 5,735,118 and 6,039,820 to Hinshaw et al. disclose the use of alkaline earth metal and transition metal complexes as gas generating compositions. The disclosed compositions comprise a metal cation and a neutral ligand containing hydrogen and nitrogen with one or more oxidizing anions to balance the charge of the complex. The preferred neutral ligands are ammonia, substituted ammonia ligands, such as hydrazine, and substituted hydrazine ligands. Optionally, burn rate enhancers, slag formers, and coolants such as magnesium hydroxide, cupric oxalate, boric acid, aluminum hydroxide, and silicotungstic acid, may be used. As the complexes produce a significant amount of slag during combustion, gas filtration is required.

U.S. Pat. No. 3,806,461 to Hendrickson et al. discloses gas generating compositions comprising a mixture of potassium perchlorate, cupric oxalate and a relatively small amount of a polymeric fuel binder to provide a relatively cool gas. The patent discloses that, when heated, cupric oxalate decomposes exothermically to produce copper, cuprous oxide, carbon dioxide, and carbon monoxide, providing the driving force that results in a relatively high burning rate. The potassium perchlorate is used to burn the polymeric fuel binder, and to remove carbon monoxide by oxidizing that toxic gas to carbon dixoide. However, although the decomposition of cupric oxalate produces a cool gas, the decomposition of cupric oxalate is actually endothermic, and cupric oxalate alone does not provide the energetic output available from pyrotechnic compositions.

Therefore, a need exists for an energetic, pyrotechnic gas generating composition that generates cool, non-toxic gases on combustion with the production of low levels of solids. The present invention provides such a composition.

SUMMARY OF THE INVENTION

The invention is directed to a low-solids gas generating composition and to a method of producing a gas from the combustion of the composition with the production of low solids. The low-solids gas generating composition of the invention comprises a mixture of a fuel selected from the group consisting of guanidine nitrate, nitroguanidine, cellulose, cellulose acetate, hexamine, 5-amino-tetrazole, 5-nitro-uracil, guanidine salt of 5-nitro-uracil, and mixtures thereof, an oxidizer selected from the group consisting of ceric ammonium nitrate, strontium nitrate, basic copper nitrate, a mixture of ammonium perchlorate and at least one alkali metal salt, and mixtures thereof, and a cupric oxalate hemi-hydrate coolant. The oxidizer-fuel mixture in the gas generating compositions of the invention is within about 4 percent of stoichiometric balance, and the low-solids gas generating composition produces no more than about 0.085 cubic centimeters, preferably, no more than 0.082 cubic centimeters, more preferably, no more than 0.077 cubic centimeters, and, most preferably, no more than 0.056 cubic centimeters of solids per gram of gas generating composition on combustion. The compositions of the invention may also comprise at least one of sub-micron fumed silica and graphite.

Preferred gas generating compositions in accordance with the invention include the following:

Mixtures comprising ammonium perchlorate, sodium nitrate, cupric oxalate hemi-hydrate, and guanidine nitrate, where the mixture preferably comprises from about 14.6 to about 23.2 percent ammonium perchlorate, from about 11.1 to about 17.6 percent, sodium nitrate, about 20 percent cupric oxalate hemi-hydrate, from about 54.2 to about 39 percent guanidine nitrate, and up to about 0.2 percent fumed silica or from about 10.1 to about 20.4 percent ammonium perchlorate, from about 7.6 to about 15.5 percent sodium nitrate, about 40 percent cupric oxalate hemi-hydrate, from about 42.2 to about 23.9 percent guanidine nitrate, and up to about 0.2 percent fumed silica;

Mixtures comprising ammonium perchlorate, potassium nitrate, cupric oxalate hemi-hydrate, and guanidine nitrate, where the mixture preferably comprises from about 9.8 to about 19.8 percent ammonium perchlorate, from about 8.8 to about 17.9 percent potassium nitrate, about 40 percent cupric oxalate hemi-hydrate, and from about 41.4 to about 22.3 percent guanidine nitrate;

Mixtures comprising ammonium perchlorate, lithium carbonate, cupric oxalate hemi-hydrate, and guanidine nitrate, where the mixture preferably comprises from about 16.9 to about 34.2 percent ammonium perchlorate, from about 5.6 to about 11.3 percent lithium carbonate, about 40 percent cupric oxalate hemi-hydrate, and from about 37.5 to about 14.5 percent guanidine nitrate;

Mixtures comprising ceric ammonium nitrate, cupric oxalate hemi-hydrate, and guanidine nitrate, where the mixture preferably comprises from about 18.6 to about 37.7 percent ceric ammonium nitrate, about 40 percent cupric oxalate hemi-hydrate, from about 41.2 to about 21.9 percent guanidine nitrate, percent and up to about 0.4 percent fumed silica;

Mixtures comprising strontium nitrate, cupric oxalate hemi-hydrate, and guanidine nitrate, where the mixture preferably comprises from about 14.2 to about 34.5 percent strontium nitrate, about 50 percent cupric oxalate hemi-hydrate, and from about 35.8 to about 15.5 percent guanidine nitrate;

Mixtures comprising ammonium perchlorate, lithium carbonate, cupric oxalate hemi-hydrate, and nitroguanidine, where the mixture preferably comprises from about 19.3 to about 35.3 percent ammonium perchlorate, from about 6.4 to about 11.7 percent lithium carbonate, about 40 percent cupric oxalate hemi-hydrate, and from about 34.3 to about 13 percent nitroguanidine;

Mixtures comprising ammonium perchlorate, sodium nitrate, cupric oxalate hemi-hydrate, and cellulose, where the mixture preferably comprises from about 19.8 to about 24.4 percent ammonium perchlorate, from about 15 to about 18.6 percent sodium nitrate, about 50 percent cupric oxalate hemi-hydrate, from about 15 to about 6.8 percent cellulose, and up to about 0.2 percent fumed silica;

Mixtures comprising ammonium perchlorate, sodium nitrate, cupric oxalate hemi-hydrate, and cellulose acetate, where the mixture preferably comprises from about 20.5 to about 24.7 percent ammonium perchlorate, from about 15.5 to about 18.8 percent sodium nitrate, about 50 percent cupric oxalate hemi-hydrate, from about 13.8 to about 6.3 percent cellulose acetate, and up to about 0.2 percent fumed silica;

Mixtures comprising ammonium perchlorate, sodium nitrate, percent cupric oxalate hemi-hydrate, and hexamine, where the mixture preferably comprises from about 22.8 to about 25.8 percent ammonium perchlorate, from about 17.3 to about 19.6 percent sodium nitrate, about 50 percent cupric oxalate hemi-hydrate, from about 9.7 to about 4.4 percent hexamine, and up to about 0.2 percent fumed silica;

Mixtures comprising strontium nitrate, cupric oxalate hemi-hydrate, and anhydrous 5 amino-tetrazole, where the mixture preferably comprises from about 27.9 to about 40.5 percent strontium nitrate, about 50 percent cupric oxalate hemi-hydrate, and from about 22.1 to about 9.5 percent anhydrous 5 amino-tetrazole;

Mixtures comprising basic copper nitrate, cupric oxalate hemi-hydrate, and 5 nitro-uracil, where the mixture preferably comprises from about 27.9 to about 50 percent basic copper nitrate, about 50 percent cupric oxalate hemi-hydrate, and from about 22.1 to 0 percent 5 nitro-uracil;

Mixtures comprising basic copper nitrate, cupric oxalate hemi-hydrate, guanidine salt of 5 nitro-uracil, where the mixture preferably comprises from about 31.7 to about 50 percent basic copper nitrate, about 50 percent cupric oxalate hemi-hydrate, from about 18.3 to 0 percent guanidine salt of 5-nitro-uracil; and Low-solids gas generating compositions in accordance with the invention also include mixtures comprising from about 20 to about 70 percent copper oxalate hemi-hydrate and one of from about 10 to about 55 percent guanidine nitrate; from about 10 to about 55 percent nitroguanidine; from about 5 to about 25 percent cellulose; from about 5 to about 25 percent cellulose acetate; from about 3 to about 15 percent hexamine from about 5 to about 35 percent 5-aminotetrazole; from about 5 to about 35 percent 5-nitrouracil; and from about 5 to about 35 percent guanidine salt of 5-nitrouracil.

The method of the invention comprises preparing a mixture of a fuel and an oxidizer, where the mixture is within about 4 percent of stoichiometric balance, mixing the oxidizer-fuel mixture with a cupric oxalate hemi-hydrate coolant; and combusting the mixture of oxidizer, fuel, and coolant, thereby producing a gas and no more than about 0.085 cubic centimeters of solids per gram of gas generating composition on combustion, where the fuel is selected from the group consisting of guanidine nitrate, nitroguanidine, cellulose, cellulose acetate, hexamine, 5-amino-tetrazole, 5-nitro-uracil, guanidine salt of 5-nitro-uracil, and mixtures thereof; and the oxidizer is selected from the group consisting of ceric ammonium nitrate, strontium nitrate, basic copper nitrate, a mixture of ammonium perchlorate and at least one alkali metal salt, and mixtures thereof. The method may further comprise adding sub-micron fumed silica as a desiccant to the mixture of oxidizer, fuel, and coolant.

DETAILED DESCRIPTION OF THE PREFERRED EMBODIMENTS

Unless otherwise stated, all references to "percent" or "%" refer to percent by weight based on the total weight of the composition.

As used herein, the term "stoichiometric balance" means that the ratio of oxidizer to fuel is such that upon combustion of the composition all of the fuel is fully oxidized, and no excess of oxygen is produced. A "near stoichiometric balance" is one in which the ratio of oxygen mass surplus or deficit to total mixture mass is within about 4 percent of a stoichiometric balance.

As used herein, the terms "low solids" and "low levels of solids" mean that, upon combustion, the gas generant produces substantially lower solids than gas generants used in prior art pyrotechnic inflators, such as sodium azide based inflators, which produce about 60 percent solids on combustion; i.e., from about 0.16 to about 0.2 cubic centimeters of solids per gram of gas generant. The gas generants of the invention typically produce less than about 0.085 cubic centimeters of solids per gram of gas generant. This is advantageous in that it minimizes or eliminates the need for a filter in the inflator, thus, simplifying inflator design.

Also, as used herein, the term "cellulose" refers to polymers that are typically of the general formula $C_{12n}H_{10n}O_{5n}$, where n is the number of repeating units in the polymer chain, and includes, but is not limited to, cellulosic polymers, such as, e.g., microcrystalline cellulose, starches, such as, e.g., corn and potato starches, dextrin, and gums, such as, e.g., guar gum and xanthan gum.

All flame temperatures referred to herein are adiabatic flame temperatures calculated with the thermochemical equilibrium combustion code PEPCODE.

The present invention is directed to gas generant compositions that produce a high volume of relatively cool, relatively non-toxic gases upon combustion with low generation of residual solids. Preferred embodiments of the invention are well suited as non-azide gas generants for use in filterless vehicle air bag inflators, that is, gas generants that do not require a metal azide as a necessary component. The compositions disclosed herein produce low levels of solids during combustion, and minimize or eliminate the need for filters or hybrid operation.

An example of a filterless air bag inflator is provided in U.S. Pat. No. 5,551,725 to Ludwig, the teachings of which are incorporated herein by reference to the extent necessary to supplement this specification. The inflator described in the above identified application comprises an interior volume, a pyrotechnic gas generant for producing an inflation gas, an initiating system for initiating the production of the inflation gas, and an exhaust orifice that provides an exhaust path and controls the flow of the inflation gas. The pyrotechnic gas generant is typically a mixture of a fuel and oxidizer that is stable, and will not ignite until the initiating system ignites the mixture to produce the inflation gas.

A typical inflator functions by converting an electrical or mechanical initiating signal into the generation of a precisely controlled quantity of gas at precisely controlled rates. Preferably, this is accomplished by an inflator pyrotechnic train, which comprises an initiator, a main gas generant charge, and, optionally, an enhancer charge between the initiator and the main gas generant charge, all of which are contained in the body of the inflator. In response to the initiating signal, the initiator ignites and produces hot gas, particulates, and/or flame. The flame output of the initiator is typically small, and may require enhancement to ignite the main gas generant charge. The initiator flame ignites at least one of the main gas generant charge and the enhancer charge. The optional enhancer charge is typically a hot burning propellant that augments the initiator output sufficiently to ignite the main gas generant charge. Once ignited, the gas generant burns to produce the hot gas required at a rate sufficient to fill the air bag module in the required time.

The gas generant compositions of the invention comprise a primary fuel, a primary oxidizer, and cupric oxalate hemi-hydrate as a primary coolant, and may further comprise additional additives, such as, e.g., burn rate catalysts, anti-oxidants, and manufacturing aides. The primary fuel and oxidizer are the primary source of heat and energy during combustion of the composition, and are selected to produce a low volume of solids upon combustion. As a result, there is little or no significant increase in the volume of solids produced by the gas generant charge upon combustion, as compared to the volume of solids produced by the decomposition of pure cupric oxalate hemi-hydrate. Upon combustion without the primary coolant, the primary fuel and oxidizer provide a non-toxic gas having a temperature high enough to require significant cooling to provide a gas having a sufficiently low temperature required in applications, such as vehicular air bags.

The cupric oxalate hemi-hydrate coolant is present in the composition in an amount sufficient to reduce the flame temperature to the required level, which is typically less than about 2000° C., and, preferably, less than about 1600° C. In contrast, as discussed above, typical prior art non-azide gas generants that have the desired performance requirements, such as, e.g., burn rate, operating pressure, low toxicity, and low volume of unwanted solid combustion byproducts, typically have adiabatic flame temperatures of greater than 2000° C.

To cool the adiabatic flame temperature sufficiently, the amount of cupric oxalate hemi-hydrate coolant used in the gas generant compositions of the invention is preferably greater than about 10 percent by mass, and, more preferably, greater than about 20 percent by mass. The cupric oxalate hemi-hydrate coolant can be used to lower flame temperatures as low as required provided the resulting composition meets the application's performance requirements, including burn rate, operation pressure, and ignitability. With the present invention, flame temperatures below 1000° C. may be obtained in gas generants that support continuous combustion at ambient temperature and pressure, which is highly desirable feature in certain applications, such as, e.g., inflation of devices that require sustained pressurization, such as vehicular rollover protection airbags, life rafts, and other such buoyancy devices and emergency slides for air planes. Gas generating compositions that burn at ambient temperature and pressure allow the use of very simple, light weight containers as the gas generator case, providing gas generators having masses and volumes less than half that of an equivalent pressurized gas system.

Cupric oxalate hemi-hydrate has many desirable characteristics as a coolant for use in low temperature gas generating compositions. It decomposes upon heating above about 250° C. in an inert atmosphere to nearly pure $CO_2$ and $H_2O$, with a very low volume of solid decomposition byproducts in the form of copper, which has a relatively high density of 8.9 grams per cubic centimeter. As the solid byproducts account for about 40 percent of the mass of the cupric oxalate hemi-hydrate, each gram of coolant produces only about 0.045 cubic centimeters of solid byproduct. In addition copper has a melting point of 1083° C., and, thus, compositions having a flame temperature on the order of 1100° C. or higher, such as most of the compositions of the invention, produce copper in the liquid state. The combination of those factors, i.e., the very low volumes of copper evolved by the coolant, the high density of copper, and its liquid state leaving the surface of the gas generant grains during combustion, makes trapping the solids very easy. No separation or filtration above and beyond that provided by the interior walls of the combustion chamber is typically required, as the copper tends to "slag up" in the combustion chamber, forming a "clinker", and any remaining copper in the gas stream tends to separate due to the centrifugal forces caused as the gas turns and weaves through the combustion chamber making its way to the exit orifices of the device. This residual copper simply separates out because of its high density relative to the gases, and plates out on the inside walls of the gas generator. Therefore, cupric oxalate hemi-hydrate in and of itself does not require complex filtration.

Copper oxalate hemi-hydrate coolant is also an efficient gas producer, producing about 1.25 moles of nearly pure $CO_2$ and about 0.31 moles of nearly pure water per 100 grams of coolant upon decomposition. For the decomposition of 100 grams of coolant, this provides a total of about 1.56 moles of gas, which corresponds to about 35 liters of gas in an inflatable at one atmosphere pressure and typical ambient temperature, i.e., about 25° C. As will be understood by those skilled in the art, the volume of gas will be larger at higher temperatures, such that at a final temperature of 75° C. the gas produced would have a volume of about 41 liters, and, at a final temperature of 100° C., a volume of about 44 liters. For the same 100 grams of cupric oxalate hemi-hydrate, the volume of the solid byproducts produced by the decomposition is only about 4.5 cubic centimeters, an amount that is easily trapped. At standard temperature and pressure, this corresponds to a solid to gas volume ratio of only 1.18:10,000, or 0.00018. Moreover, copper oxalate hemi-hydrate has other advantages, e.g., it is relatively inexpensive, readily available in bulk quantities, and very stable, showing no sign of decomposition after storage for several days at temperatures in excess of about 200° C.

The decomposition of cupric oxalate hemi-hydrate is substantially endothermic, making it an excellent coolant. However, it has been discovered that in many gas generant systems cupric oxalate hemi-hydrate also acts as a burn rate catalyst. In such a composition, a small quantity of cupric oxalate hemi-hydrate increases the burn rate of the gas generant, allowing cupric oxalate hemi-hydrate to be used in large mass percentages, producing a reduction in the burn rate less than that produced by other coolants when used in an amount adequate to achieve the adiabatic flame temperature achieved with cupric oxalate hemi-hydrate as a coolant.

The catalytic effect of cupric oxalate hemi-hydrate on the combustion of gas generants also prevents the increase in toxic species produced in the generated gas that typically occurs when other coolants are added in large percentages. The production of toxic species increases with the addition of large quantities of other coolants because the coolant reduces the flame temperature and slows the combustion of gas generant. The resulting combustion is too slow to allow complete combustion of the gas generant before the generated gases leave the gas generator, producing a significant increase in the toxicity of the effluent gases. In contrast to prior art coolants, the catalytic effect of the cupric oxalate hemi-hydrate on gas generant combustion allows the gas generants to combust completely at temperatures significantly lower than would otherwise be practical, allowing the formulation of gas generants having large percentages of cupric oxalate hemi-hydrate without producing appreciable amounts of toxic gases. Thus, gas generants of the invention have flame temperatures much lower than typical prior art gas generants, while providing the desired burn rates and low toxicity gases.

The primary fuel and oxidizer in the gas generant compositions of the invention are selected to provide a low volume of solids upon combustion in a form that is easily trapped. Any solids produced with the gas generants of the invention preferably have a high density, and, as with the copper produced by the decomposition of cupric oxalate hemi-hydrate, are preferably liquid or a mixture of liquid and solid at the combustion temperature of the gas generant. Moreover, the fuel and oxidizer should be selected and balanced in proportions sufficient to provide a low level of gas toxicity. U.S. Pat. No. 5,780,768 to Knowlton, et al., the teachings of which are incorporated herein by reference to the extent necessary to supplement this specification, provides a good description of how to balance the fuel and oxidizer amounts in the composition to minimize gas toxicity. The constituents of the composition are selected to produce an output gas consisting essentially of carbon dioxide, nitrogen, water, and oxygen.

Any halogens or sulfur present in the composition may form toxic or corrosive compounds during combustion. Therefore, the gas generant composition should also contain a corresponding alkali metal salt in the composition in a molar amount equal to or greater than the molar amount of halogens or sulfur in the composition. During combustion, the alkali metal salt will react with and remove any halogen or sulfur compounds produced during combustion by forming the corresponding alkali metal halogen or sulfur containing salt. Any salt produced may then be separated as a solid, such as, e.g., sodium nitrate or sodium carbonate in the original composition to create sodium chloride or sodium sulfide or sulfate in a solid form, which is then separated from the generated gases. This is described in detail in U.S. Pat. No. 5,780,768. The oxygen balance, i.e., the ratio of oxidizer to fuel in the composition should be within about four percent of stoichiometric balance, again, as described in U.S. Pat. No. 5,780,768. The cupric oxalate hemi-hydrate coolant does not need to be taken into account when balancing the stoichiometry of the composition, as cupric oxalate hemi-hydrate is stoichiometric in and of itself. That is, in the decomposition to copper, carbon dioxide, and water, the molecular formula of cupric oxalate hemi-hydrate is such that its oxidizer to fuel balance is already stoichiometric without the addition of any fuel or oxidizer. However, cupric oxalate hemi-hydrate may also be combusted in the presence of excess oxidizer to form cuprous oxide and/or cupric oxide or a combination of copper and cuprous oxide and/or cupric oxide. In the case of excess oxidizer, the limit of within about four percent of stoichiometric balance applies to the amount of oxidizer above and beyond that required to combust all of the copper to cupric oxide. That is, sufficient oxidizer must be added to burn all the carbon to $CO_2$, all of the hydrogen to $H_2O$, and all of the copper to CuO before counting the excess oxidizer toward the four percent of stoichiometric balance limit.

For an exemplary mixture comprising guanidine nitrate, strontium nitrate, and 40 percent by weight cupric oxalate hemi-hydrate, the limit of plus and minus four percent of stoichiometric for the oxygen balance is determined as follows:

First, guanidine nitrate, $C(NH_2)_3NO_3$, which may also be represented by $QNO_3$, requires about 0.262 grams of oxygen per gram (of guanidine nitrate) to combust stoichiometrically to form $CO_2$, $N_2$, and $H_2O$, i.e., 1 mole of oxygen per mole of guanidine nitrate, which is equivalent to 2 atoms of oxygen per molecule of guanidine nitrate. In addition, strontium nitrate produces about 0.378 grams of oxygen per gram of strontium nitrate upon decomposition, which is equivalent to 2.5 moles of oxygen per mole of strontium nitrate, $Sr(NO_3)_2$. As discussed above, cupric oxalate hemi-hydrate does not require any additional oxygen to combust stoichiometrically to copper, water, carbon dioxide, and nitrogen. However, an amount of oxygen of up to 0.100 grams of oxygen per gram of cupric oxalate hemi-hydrate may be used to form cupric oxide, which is equivalent to 0.5 mole of oxygen per mole of cupric oxalate hemi-hydrate, $CuC_2O_4$-½ $H_2O$.

The lower limit for an oxygen balance of minus four percent with respect to stoichiometric is calculated using 0 grams of oxygen to decompose each gram of cupric oxalate hemi-hydrate as follows:

$$\text{Mass fraction of } Sr(NO_3)_2 \times 0.378 - \text{mass fraction of } QNO_3 \times 0.262 = -0.04.$$

As stated above for this example, each gram of gas generant comprises 0.4 grams of cupric oxalate hemi-hydrate and, thus, a total of 0.6 grams of $QNO_3$ and $Sr(NO_3)_2$, which gives mass fraction of $Sr(NO_3)_2$=0.6−mass fraction of $QNO_3$, and (0.6−Mass fraction of $QNO_3$)×0.378−mass fraction of $QNO_3$×0.262=−0.04.

Solving those two equations yields composition mass percentages of about 41.7 percent $QNO_3$ and 18.3 percent $Sr(NO_3)_2$ for a composition containing 40 percent cupric oxalate hemi-hydrate and having an oxygen balance of four weight percent less than the stoichiometric balance.

The upper limit for an oxygen balance of plus four percent with respect to stoichiometric is calculated using 0.1 grams of oxygen per gram of cupric oxalate hemi-hydrate, as follows:

Mass fraction of $Sr(NO_3)_2$×0.378−mass fraction of $QNO_3$×0.262−mass fraction of $CUC_2O_4$−$H_2O$×0.1=+0.04.

Again, the mass fraction of $CuC_2O_4$−½ $H_2O$ is 0.4, which gives a total mass fraction of $Sr(NO_3)_2$ and $QNO_3$ of 0.6. Therefore, mass fraction of $Sr(NO_3)_2$=0.6−mass fraction of $QNO_3$, and (0.6−mass fraction $QNO_3$)×0.378−mass fraction $QNO_3$×0.262−0.4−0.1=+0.04.

Solving those two equations yields composition mass percentages of about 22.9 weight percent $QNO_3$ and 37.1 weight percent $Sr(NO_3)_2$ for a composition containing 40 percent cupric oxalate hemi-hydrate, and having an oxygen balance of four weight percent greater than the stoichiometric balance.

Sub-micron fumed silica, such as Cabosil®, a product of Cabot Corporation of Tuscola, Ill., is preferably added to compositions containing a hygroscopic ingredient. Cabosil® and similar very fine, sub-micron particle size, high surface area fumed silicas, minimize contamination by moisture, and act as a flow aid when the compositions are in a powdered form prior to pressing into grains or pellets.

EXAMPLES

The following non-limiting examples are merely illustrative of the preferred embodiments of the present invention, and are not to be construed as limiting the invention, the scope of which is defined by the appended claims. All percentages are given in weight or mass percent.

Example 1

Ammonium Perchlorate 18.8%

Sodium Nitrate 14.2%

Cupric Oxalate Hemi-hydrate 20%

Guanidine Nitrate 46.8%

Fumed Silica 0.2%

This composition provides an adiabatic flame temperature of 1740° C., and generates about 3.1 moles of gas per 100 grams of gas generant combusted. The solid byproducts of combustion are principally composed of about 9 percent NaCl and about 8 percent copper, based on the total mass of the gas generant composition, for a total of about 0.054 cc of solids per gram of gas generant.

Example 2

Ammonium Perchlorate 14.1%

Sodium Nitrate 10.7%

Cupric Oxalate Hemi-hydrate 40%

Guanidine Nitrate 35.1%

Fumed Silica 0.1%

This composition provides an adiabatic flame temperature of 1526° C., and generates about 2.7 moles of gas per 100 grams of gas generant combusted. The solid byproducts of combustion are principally composed of about 7.4 percent NaCl and about 16 percent copper, based on the total mass of the gas generant composition, for a total of about 0.053 cc of solids per gram of gas generant.

Example 3

Ammonium Perchlorate 13.7%

Potassium Nitrate 12.3%

Cupric Oxalate Hemi-hydrate 40%

Guanidine Nitrate 34.0%

This composition provides an adiabatic flame temperature of 1503° C., and generates about 2.65 moles of gas per 100 grams of gas generant combusted. The solid byproducts of combustion are principally composed of about 9.1 percent KCl and about 16 percent copper, based on the total mass of the gas generant composition, for a total of about 0.061 cc of solids per gram of gas generant.

Example 4

Ammonium Perchlorate 23.7%

Lithium Carbonate 7.9%

Cupric Oxalate Hemi-hydrate 40%

Guanidine Nitrate 28.4%

This composition provides an adiabatic flame temperature of 1403° C., and generates about 2.6 moles of gas per 100 grams of gas generant combusted. The solid byproducts of combustion are principally composed of about 9.1 percent LiCl and about 16 percent copper, based on the total mass of the gas generant composition, for a total of about 0.061 cc of solids per gram of gas generant.

Example 5

Ceric Ammonium Nitrate 26.0%

Cupric Oxalate Hemi-hydrate 40%

Guanidine Nitrate 33.7%

Fumed Silica 0.3%

This composition provides an adiabatic flame temperature of 1512° C., and generates about 2.65 moles of gas per 100 grams of gas generant combusted. The solid byproducts of combustion are principally composed of about 7.8 percent ceric oxide and about 16 percent copper, based on the total mass of the gas generant composition, for a total of about 0.029 cc of solids per gram of gas generant.

Example 6

Strontium Nitrate 20.5%

Cupric Oxalate Hemi-hydrate 50%

Guanidine Nitrate 29.5%

This composition provides an adiabatic flame temperature of 1311° C., and generates about 2.3 moles of gas per 100 grams of gas generant combusted. The solid byproducts of combustion are principally composed of about 10.0 percent SrO and about 20 percent copper, based on the total mass of the gas generant composition, for a total of about 0.044 cc of solids per gram of gas generant.

Example 7

Ammonium Perchlorate 25.4%

Lithium Carbonate 8.4%

Cupric Oxalate Hemi-hydrate 40%

Nitroguanidine 26.2%

This composition provides an adiabatic flame temperature of 1589° C., and generates about 2.5 moles of gas per 100 grams of gas generant combusted. The solid byproducts of combustion are principally composed of about 9.6 percent LiCl and about 16 percent copper, based on the total mass of the gas generant composition, for a total of about 0.064 cc of solids per gram of gas generant.

Example 8

Ammonium Perchlorate 21.4%

Sodium Nitrate 16.2%

Cupric Oxalate Hemi-hydrate 50%

Cellulose 12.2%

Fumed Silica 0.2%

This composition provides an adiabatic flame temperature of 1614° C., and generates about 2.15 moles of gas per 100 grams of gas generant combusted. The solid byproducts of combustion are principally composed of about 11.1 percent NaCl and about 20 percent copper for a total of about 0.075 cc of solids per gram of gas generant.

Example 9

Ammonium Perchlorate 21.9%

Sodium Nitrate 16.7%

Cupric Oxalate Hemi-hydrate 50%

Cellulose Acetate 11.2%

Fumed Silica 0.2%

This composition provides an adiabatic flame temperature of 1654° C., and generates about 2.1 moles of gas per 100 grams of gas generant combusted. The solid byproducts of combustion are principally composed of about 11.5 percent NaCl and about 20 percent copper for a total of about 0.077 cc of solids per gram of gas generant.

Example 10

Ammonium Perchlorate 23.8%

Sodium Nitrate 18.1%

Cupric Oxalate Hemi-hydrate 50%

Hexamine 7.9%

Fumed Silica 0.2%

This composition provides an adiabatic flame temperature of 1727° C., and generates about 2.15 moles of gas per 100 grams of gas generant combusted. The solid byproducts of combustion are principally composed of about 12.5 percent NaCl and about 20 percent copper for a total of about 0.082 cc of solids per gram of gas generant.

Example 11

Strontium Nitrate 31.8%

Cupric Oxalate Hemi-hydrate 50%

5 Amino Tetrazole (anhydrous) 18.2%

This composition provides an adiabatic flame temperature of 1712° C., and generates about 2.0 moles of gas per 100 grams of gas generant combusted. The solid byproducts of combustion are principally composed of about 15.5 percent SrO and about 20 percent copper, based on the total mass of the gas generant composition, for a total of about 0.056 cc of solids per gram of gas generant.

Example 12

Basic Copper Nitrate 32.6%

Cupric Oxalate Hemi-hydrate 50%

5 Nitro-uracil 17.4%

This composition provides an adiabatic flame temperature of 978° C., and generates about 1.85 moles of gas per 100 grams of gas generant combusted. The solid byproducts of combustion are principally composed of about 36.8 percent copper, based on the total mass of the gas generant composition, for a total of about 0.041 cc of solids per gram of gas generant.

Example 13

Basic Copper Nitrate 35.6%

Cupric Oxalate Hemi-hydrate 50%

Guanidine salt of 5 Nitro-uracil 14.4%

This composition provides an adiabatic flame temperature of 872° C., and generates about 1.85 moles of gas per 100 grams of gas generant combusted. The solid byproducts of combustion are principally composed of about 38.5 percent copper, based on the total mass of the gas generant composition, for a total of about 0.043 cc of solids per gram of gas generant.

Example 14

Basic Copper Nitrate 7 micron 40.4%

Guanidine Nitrate 10 micron 6.6%

5 Nitro-uracil 4 micron 18.6%

Cupric Oxalate Hemi-hydrate 33.3%

Graphite 0.3%

Fumed Silica 0.8%

The cupric oxalate hemi-hydrate, graphite, and fumed silica were used in the "as received" particle size. The cupric oxalate hemi-hydrate was obtained from Bernardy Chemie of Theniux, France through their U.S. distributor, Ingraham and Company, of Houston, Tex. This material is about 8 micron in particle size "as received". The Cabosil® is sub-micron fumed silica available from Cabot Corp. of Tuscola, Ill. The graphite is Micro-Mesh −325 mesh Graphite available from Superior Graphite Co. of Chicago, Ill. The basic copper nitrate was purchased from Shepherd Chemical Co. of Norwood, Ohio. The guanidine nitrate was obtained from Sigma Aldrich Fluka bulk chemicals division of Milwaukee, Wis. The 5 nitro-uracil was obtained from BFGoodrich Pharmaceuticals Division of Raubling Germany. The fumed silica was first pre-blended with the basic copper nitrate to coat the basic copper nitrate with the fumed silica to aid in tablet pressing. The balance of the materials were added to the fumed silica coated basic copper nitrate and blended together. The resulting blended material was pressed into a ⅜" diameter by about 1.2 inch long cylinder using about 100,000 psi to press the cylindrical burn strand. The strand was ignited with a nichrome wire and allowed to burn to completion at ambient temperature and pressure. The average burn rate was about 0.058 inches per second. The strand burned in a cigarette-like fashion leaving the solid residue of combustion attached to the burn strand as it combusted. The strand burned with no apparent gaseous flame. The theoretical adiabatic flame temperature of this composition is 1134° C., and the volume of solids produced is about 0.043 cubic centimeters per gram.

Example 15

Basic Copper Nitrate 7 micron 30.3%

Guanidine Nitrate 10 micron 4.9%

5 Nitro-uracil 4 micron 14.0%

Cupric Oxalate Hemi-hydrate 50.0%

Graphite 0.2%

Fumed Silica 0.6%

The cupric oxalate hemi-hydrate, graphite, and fumed silica were used in the "as received" particle size. All materials were obtained from the same sources as those provided in example 14. The blending was performed as described in example 14. The resulting blended material was pressed into a ⅜" diameter by about 1.2 inch long cylinder using about 100,000 psi to press the cylindrical burn strand. The strand was ignited with a nichrome wire, and allowed to burn to completion at ambient temperature and pressure. The average burn rate was about 0.031 inches per second. The strand burned in a cigarette-like fashion, leaving the solid residue of combustion attached to the burn strand as it combusted. The strand burned with no apparent gaseous flame. The theoretical adiabatic flame temperature of this composition is 939° C., and the volume of solids produced is about 0.043 cubic centimeters per gram.

Example 16

Ammonium Perchlorate 15 micron 19.8%

Sodium Nitrate 10 micron 15.0%

Cellulose 6 micron 11.7%

Cupric Oxalate Hemi-hydrate 53.3%

Fumed Silica 0.2%

The cupric oxalate hemi-hydrate and fumed silica were used in the "as received" particle size. The cupric oxalate hemi-hydrate and fumed silica were obtained from the same sources as those provided in example 14. The ammonium perchlorate was obtained from American Pacific Corp. of Las Vegas, Nev. The sodium nitrate was obtained from Hummel Croton Inc., South Plainfield, N.J. The microcrystalline cellulose was obtained from FMC Corp. of Philadelphia, Pa. The blending was performed as described in example 14, except the sodium nitrate was pre-blended with the fumed silica. The resulting blended material was pressed into a ⅜" diameter by about 1.3 inch long cylinder using about 100,000 psi to press the cylindrical burn strand. The strand was ignited with a nichrome wire, and allowed to burn to completion at ambient temperature and pressure. The average burn rate was about 0.032 inches per second. The strand burned in a cigarette-like fashion, leaving the solid residue of combustion attached to the burn strand as it combusted. The strand burned with no apparent gaseous flame. The theoretical adiabatic flame temperature of this composition is 1559° C., and the volume of solids produced is about 0.074 cubic centimeters per gram.

Example 17

The formulation of example 16 was pressed into burn strands of approximately ⅜" diameter by about 1 to 1.5 inches using the procedure described in example 16. The length of the burn strand was recorded for each burn strand. The strands were inhibited with acrylic adhesive backed glass cloth tape on all surfaces except the ignition end. A minimum of three strands were burned at atmospheric pressure and at ambient temperature. The burn time of each strand was recorded using a stopwatch. The burn rate for each strand was determined by dividing the length of each discrete burn strand by the burn time determined using a stopwatch for that discrete burn strand. The average bum rate was determined to be 0.04 inches per second at atmospheric pressure.

Example 18

The mixture of example 16 was pressed into tablets of about 0.25 inches diameter and an average thickness of 0.154 inches. The blended material was first slugged into 1 ⅛ inch diameter by about 0.1 to about 0.3 inch thick slugs using a Stokes model R tablet press at about 60,000 psi. The slugs were granulated with a 16 mesh granulation screen on a Stokes granulator. These granules were sieved with a 60 mesh screen to remove any fine, i.e., less than about 60 mesh, granules or powder, and the remaining +60 mesh granules were coated with 1 percent by mass of graphite to prevent any sticking during tablet pressing. The tablets were pressed on a Stokes model T press to a final tablet dimension of about 0.25 inch diameter by 0.154 inch thickness on average. The press was adjusted until the resulting tablet was very hard and difficult to break, with a glossy surface. Based on prior pressing of burn strands, the press force during this operation was about 100,000 psi at the tablet. A load of 27.5 grams of these tablets was placed into a cylindrical side impact type inflator with about a 0.82 inch inside diameter, an inside length of about 6 inches, and sufficient structural integrity to withstand operating pressures of up to 20,000 psi without rupture. The inflator used a automotive initiator by Special Devices Incorporated of Moore Park, Calif., to initiate the gas generant tablets. The initiator had a load of 200 milligrams of boron potassium nitrate. The inflator had a single sharp edged exhaust nozzle with a diameter of about 0.26 inches. The exhaust nozzle was sealed on the inside of the inflator with a piece of pressure sensitive one ounce copper foil tape (0.0014" thick copper backed by 0.002" thick acrylic pressure sensitive adhesive). The tape acts as an environmental seal and a burst disc during the initial inflator pressurization at firing. The inflator was fired in a sealed 1 cubic foot tank initially at ambient pressure and temperature prior to firing. A peak pressure of 190 kilopascals was developed in 200 milliseconds after firing. The pressure at 10 seconds was 57 kilopascals. The peak operating pressure inside the inflator was about 5000 kilopascals at about 10 to 20 milliseconds after firing.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

What is claimed is:

1. A low-solids gas generating composition, comprising a mixture of:

a fuel selected from the group consisting of guanidine nitrate, nitroguanidine, cellulose, cellulose acetate, hexamine, 5 amino-tetrazole, 5 nitro-uracil, guanidine salt of 5 nitro-uracil, and mixtures thereof;

an oxidizer selected from the group consisting of ceric ammonium nitrate, strontium nitrate, basic copper nitrate, a mixture of ammonium perchlorate and at least one alkali metal salt, and mixtures thereof, and a cupric oxalate hemi-hydrate coolant; wherein the oxidizer-fuel mixture is within about 4 percent of stoichiometric balance, and the low-solids gas generating composition produces no more than about 0.085 cubic centimeters of solids per gram of gas generating composition on combustion.

2. The gas generating composition of claim 1, wherein the low-solids gas generating composition produces no more than about 0.077 cubic centimeters of solids per gram of gas generating composition on combustion.

3. The gas generating composition of claim 1, wherein of the low-solids gas generating composition produces no more than about 0.056 cubic centimeters of solids per gram of gas generating composition on combustion.

4. The gas generating composition of claim 1, further comprising sub-micron fumed silica.

5. The gas generating composition of claim 1, further comprising graphite.

6. The gas generating composition of claim 1, comprising ammonium perchlorate, sodium nitrate, cupric oxalate hemi-hydrate, and guanidine nitrate.

7. The gas generating composition of claim 1, comprising from about 14.6 to about 23.2 percent ammonium perchlorate, from about 11.1 to about 17.6 percent, sodium nitrate, about 20 percent cupric oxalate hemi-hydrate, from about 54.2 to about 39 percent guanidine nitrate, and up to about 0.2 percent fumed silica.

8. The gas generating composition of claim 1, comprising from about 10.1 to about 20.4 percent ammonium perchlorate, from about 7.6 to about 15.5 percent sodium nitrate, about 40 percent cupric oxalate hemi-hydrate, from about 42.2 to about 23.9 percent guanidine nitrate, and up to about 0.2 percent fumed silica.

9. The gas generating composition of claim 1, comprising ammonium perchlorate, potassium nitrate, cupric oxalate hemi-hydrate, and guanidine nitrate.

10. The gas generating composition of claim 1, comprising from about 9.8 to about 19.8 percent ammonium perchlorate, from about 8.8 to about 17.9 percent potassium nitrate, about 40 percent cupric oxalate hemi-hydrate, and from about 41.4 to about 22.3 percent guanidine nitrate.

11. The gas generating composition of claim 1, comprising ammonium perchlorate, lithium carbonate, cupric oxalate hemi-hydrate, and guanidine nitrate.

12. The gas generating composition of claim 1, comprising from about 16.9 to about 34.2 percent ammonium perchlorate, from about 5.6 to about 11.3 percent lithium carbonate, about 40 percent cupric oxalate hemi-hydrate, and from about 37.5 to about 14.5 percent guanidine nitrate.

13. The gas generating composition of claim 1, comprising ceric ammonium nitrate, cupric oxalate hemi-hydrate, and guanidine nitrate.

14. The gas generating composition of claim 1, comprising from about 18.6 to about 37.7 percent ceric ammonium nitrate, from about 40 percent cupric oxalate hemi-hydrate, about from 41.2 to about 21.9 percent guanidine nitrate, percent and up to about 0.4 percent fumed silica.

15. The gas generating composition of claim 1, comprising strontium nitrate, cupric oxalate hemi-hydrate, and guanidine nitrate.

16. The gas generating composition of claim 1, comprising from about 14.2 to about 34.5 percent strontium nitrate, about 50 percent cupric oxalate hemi-hydrate, and from about 35.8 to about 15.5 percent guanidine nitrate.

17. The gas generating composition of claim 1, comprising ammonium perchlorate, lithium carbonate, cupric oxalate hemi-hydrate, and nitroguanidine.

18. The gas generating composition of claim 1, comprising from about 19.3 to about 35.3 percent ammonium perchlorate, from about 6.4 to about 11.7 percent lithium carbonate, about 40 percent cupric oxalate hemi-hydrate, and from about 34.3 to about 13 percent nitroguanidine.

19. The gas generating composition of claim 1, comprising ammonium perchlorate, sodium nitrate, cupric oxalate hemi-hydrate, and cellulose.

20. The gas generating composition of claim 1, comprising from about 19.8 to about 24.4 percent ammonium perchlorate, from about 15 to about 18.6 percent sodium nitrate, about 50 percent cupric oxalate hemi-hydrate, from about 15 to about 6.8 percent cellulose, and up to about 0.2 percent fumed silica.

21. The gas generating composition of claim 1, comprising ammonium perchlorate, sodium nitrate, cupric oxalate hemi-hydrate, and cellulose acetate.

22. The gas generating composition of claim 1, comprising from about 20.5 to about 24.7 percent ammonium perchlorate, from about 15.5 to about 18.8 percent sodium nitrate, about 50 percent cupric oxalate hemi-hydrate, from about 13.8 to about 6.3 percent cellulose acetate, and up to about 0.2 percent fumed silica.

23. The gas generating composition of claim 1, comprising ammonium perchlorate, sodium nitrate, cupric oxalate hemi-hydrate, and hexamine.

24. The gas generating composition of claim 1, comprising from about 22.8 to about 25.8 percent ammonium perchlorate, from about 17.3 to about 19.6 percent sodium nitrate, about 50 percent cupric oxalate hemi-hydrate, from about 9.7 to about 4.4 percent hexamine, and up to about 0.2 percent fumed silica.

25. The gas generating composition of claim 1, comprising strontium nitrate, cupric oxalate hemi-hydrate, and anhydrous 5 amino-tetrazole.

26. The gas generating composition of claim 1, comprising from about 27.9 to about 40.5 percent strontium nitrate, about 50 percent cupric oxalate hemi-hydrate, and from about 22.1 to about 9.5 percent anhydrous 5 amino-tetrazole.

27. The gas generating composition of claim 1, comprising basic copper nitrate, cupric oxalate hemi-hydrate, and 5 nitro-uracil.

28. The gas generating composition of claim 1, comprising from about 27.9 to about 50 percent basic copper nitrate, about 50 percent cupric oxalate hemi-hydrate, and from about 22.1 to 0 percent 5 nitro-uracil.

29. The gas generating composition of claim 1, comprising basic copper nitrate, cupric oxalate hemi-hydrate, guanidine salt of 5 nitro-uracil.

30. The gas generating composition of claim 1, comprising from about 31.7 to about 50 percent basic copper nitrate, about 50 percent cupric oxalate hemi-hydrate, from about 18.3 to 0 percent guanidine salt of 5 nitro-uracil.

31. The gas generating composition of claim 1, comprising basic copper nitrate, guanidine nitrate, 5-nitro-uracil, cupric oxalate hemi-hydrate, and graphite.

32. The gas generating composition of claim 1, comprising from about 20 to about 70 percent copper oxalate hemi-hydrate and a fuel selected from the group consisting of from about 10 to about 55 percent guanidine nitrate; from about 10 to about 55 percent nitroguanidine; from about 5 to about 25 percent cellulose; from about 5 to about 25 percent cellulose acetate; from about 3 to about 15 percent hexamine from about 5 to about 35 percent 5-aminotetrazole; from about 5 to about 35 percent 5-nitrouracil; from about 5 to about 35 percent guanidine salt of 5-nitrouracil, and mixtures thereof.

33. A method of generating a gas with low-solids, the method comprising:

preparing a mixture comprising a fuel and an oxidizer, wherein the mixture is within about 4 percent of stoichiometric balance;

mixing the oxidizer-fuel mixture with a cupric oxalate hemi-hydrate coolant; and combusting the mixture of oxidizer, fuel, and coolant, thereby producing a gas and no more than about 0.085 cubic centimeters of solids per gram of gas generating composition on combustion; wherein the fuel is selected from the group consisting of guanidine nitrate, nitroguanidine, cellulose, cellulose acetate, hexamine, 5 amino-tetrazole, 5 nitro-uracil, guanidine salt of 5 nitro-uracil, and mixtures thereof; and the oxidizer is selected from the group consisting of ceric ammonium nitrate, strontium nitrate, basic copper nitrate, a mixture of ammonium perchlorate and at least one alkali metal salt, and mixtures thereof.

34. The method of claim 33, further comprising adding sub-micron fumed silica as a desiccant to the mixture of oxidizer, fuel, and coolant.

35. The gas generating composition of claim 1, wherein the cupric oxalate hemi-hydrate coolant is present in an amount of at least about 50 percent.

36. The gas generating composition of claim 35, comprising ammonium perchlorate, sodium nitrate, cupric oxalate hemi-hydrate, and cellulose.

37. The gas generating composition of claim 36, comprising from about 19.8 to about 24.4 percent ammonium perchlorate, from about 15 to about 18.6 percent sodium nitrate, about 50 percent cupric oxalate hemi-hydrate, from about 15 to about 6.8 percent cellulose, and up to about 0.2 percent fumed silica.

38. The gas generating composition of claim 36, comprising about 19.8 percent ammonium perchlorate, about 15 percent sodium nitrate, about 53.3 percent cupric oxalate hemi-hydrate, about 11.7 percent cellulose, and about 0.2 percent fumed silica.

* * * * *

UNITED STATES PATENT AND TRADEMARK OFFICE

CERTIFICATE OF CORRECTION

PATENT NO. : 6,605,233 B2
DATED : August 12, 2003
INVENTOR(S) : Gregory D. Knowlton et al.

It is certified that error appears in the above-identified patent and that said Letters Patent is hereby corrected as shown below:

Title page,
Item [56], References Cited, FOREIGN PATENT DOCUMENTS,
"JP 2001010858 * 1/2001" should read -- JP 2001010888 * 1/2001 --.

Column 1,
Line 16, "in an" (second occurrence) should read -- in --; and
Line 25, "devices." should read -- devices, --.

Column 8,
Line 22, "highly" should read -- highly --; and
Line 26, "air planes" should read -- airplanes --.

Column 11,
Line 15, "$QNO_3\times$ 0.262-0.4-" should read -- $QNO_3\times$0.262-0.4X --.

Column 15,
Line 61, "bum" should read -- bum --.

Column 16,
Line 19, "used a" should read -- used an --; and
Line 64, "wherein of" should read -- wherein --.

Column 17,
Line 41, "from" should be deleted.
Line 42, "about from" should read -- from about --; and
Line 43, "percent" should be deleted.

UNITED STATES PATENT AND TRADEMARK OFFICE

CERTIFICATE OF CORRECTION

PATENT NO. : 6,605,233 B2
DATED : August 12, 2003
INVENTOR(S) : Gregory D. Knowlton et al.

It is certified that error appears in the above-identified patent and that said Letters Patent is hereby corrected as shown below:

Column 18,
Line 32, "guani-" should read -- and a guani- --;
Line 36, "from" should read -- and from --; and
Line 46, "hexamine" should read -- hexamine, --.

Signed and Sealed this

Twentieth Day of April, 2004

JON W. DUDAS
*Acting Director of the United States Patent and Trademark Office*